US005812070A

United States Patent [19]

Tagami et al.

[11] Patent Number: 5,812,070

[45] Date of Patent: Sep. 22, 1998

[54] SHARED VEHICLE RENTAL SYSTEM

[75] Inventors: Katsutoshi Tagami, Asaka; Masaki Ban, Shinjuku-ku; Fumitaka Takahashi, Hoya; Yasushi Okada, Fujimi, all of Japan

[73] Assignee: Honda Giken Kogyo Kabushiki Kaisha, Tokyo, Japan

[21] Appl. No.: 886,919

[22] Filed: Jul. 2, 1997

Related U.S. Application Data

[63] Continuation of Ser. No. 493,625, Jun. 22, 1995, abandoned.

[30] Foreign Application Priority Data

Jul. 29, 1994 [JP] Japan ..... 6-198003

[51] Int. Cl.[6] ..... G08G 1/00

[52] U.S. Cl. ..... 340/932.2; 340/457.4; 340/992; 701/29; 701/35

[58] Field of Search ..... 340/932.2, 457, 340/457.4, 988, 991, 992, 994; 701/1, 23, 24, 29, 35, 117

[56] References Cited

U.S. PATENT DOCUMENTS

| | | | |
|---|---|---|---|
| 3,624,608 | 11/1971 | Altman et al. | 340/825.31 |
| 3,665,397 | 5/1972 | Di Napoli et al. | 340/825.33 |
| 4,360,875 | 11/1982 | Behnke | 364/436 |
| 4,593,263 | 6/1986 | Peckworth | 340/457.1 |
| 5,066,853 | 11/1991 | Brisson | 235/381 |
| 5,206,643 | 4/1993 | Eckelt | 340/932.2 |
| 5,289,369 | 2/1994 | Hirshberg | 364/401 |
| 5,499,181 | 3/1996 | Smith | 340/457.4 |

FOREIGN PATENT DOCUMENTS

| | | |
|---|---|---|
| 0309318 | 3/1989 | European Pat. Off. . |
| 0433740 (A2) | 6/1991 | European Pat. Off. . |
| 0433740 (A3) | 6/1991 | European Pat. Off. . |
| 0451482 (A1) | 10/1991 | European Pat. Off. . |
| 95304203 | 3/1996 | European Pat. Off. . |
| 2612319 | 9/1988 | France . |
| 2662285 | 11/1991 | France . |
| 4227969 | 3/1994 | Germany . |
| 4133195 | 5/1992 | Japan . |
| 5159143 | 4/1993 | Japan . |

OTHER PUBLICATIONS

English language Abstract of JP 5–159143.
95304203 Mar. 1996 European Search Report.

*Primary Examiner*—Jeffery A. Hofsass
*Assistant Examiner*—Edward Lefkowitz
*Attorney, Agent, or Firm*—Lyon & Lyon LLP

[57] ABSTRACT

A shared vehicle rental system has a plurality of motor vehicles, a parking area for a plurality of users to rent motor vehicles therefrom and to return motor vehicles thereto, and a control center for supervising the motor vehicles. The shared vehicle rental system registers the users in a plurality of groups depending on a usage time zone in which the users use the motor vehicles, identifies registration information of the users which is recorded on IC cards of the users, and supervises the motor vehicles and the parking area based on the registration information of the users.

12 Claims, 6 Drawing Sheets

SHARED VEHICLE RENTAL SYSTEM

This application is a Continuation Application of application Ser. No. 08/493,625 filed on Jun. 22, 1995 now abandoned.

BACKGROUND OF THE INVENTION

1. Field of the Invention

The present invention relates to a rental system for renting motor vehicles that are shared by a plurality of users, and more particularly to a shared vehicle rental system optimum for sharing a plurality of motor vehicles in a certain geographical region that is determined in terms of vehicle management and rental service.

2. Description of the Prior Art

There have been proposed various shared vehicle rental systems for efficiently sharing motor vehicles among a plurality of users with a view to giving the users a better chance to attain transportation smoothly and also to minimizing harmful motor vehicle emissions. For example, a shared vehicle rental system disclosed in Japanese laid-open patent publication No. 5-159143 has communication means installed on a plurality of motor vehicles for sending vehicle usage information, and a control room for supervising the motor vehicles under centralized control based on the vehicle usage information from the communication means. The disclosed shared vehicle rental system requires users to be registered beforehand in the control room. Once a user has been registered, the user can rent a motor vehicle from a parking lot near a start point at any time without reservations, and can return the motor vehicle to a parking lot near an end point immediately after having moved using the motor vehicle. The control room is always aware of the whereabouts of the motor vehicles, and prohibits persons other than the registered users from using the motor vehicles and also prohibits the users from leaving the motor vehicles at places other than predetermined parking lots. In the disclosed shared vehicle rental system, a registered user can be confirmed by the control room when the user inserts his IC card into an IC card reader in a motor vehicle and the IC card reader sends user information through transmitter and receiver units to the control room.

Since the disclosed shared vehicle rental system allows any registered users to rent motor vehicles without reservations and hence cannot recognize the times when registered users are to use motor vehicles, the shared vehicle rental system is required to have as many motor vehicles as the number of registered users available for rent in case all the registered users happen to rent the motor vehicles. Therefore, the shared vehicle rental system is also required to have a large space in which to park the motor vehicles. The number of necessary motor vehicles may be reduced by introducing reservation principles into the shared vehicle rental system. However, it will pose another problem in that the acceptance of random reservations may result in a number of motor vehicles that are not used for a long period of time, lowering the usage or operating efficiency of each motor vehicle.

SUMMARY OF THE INVENTION

It is therefore an object of the present invention to provide a shared vehicle rental system which increases the usage or operating efficiency of each motor vehicle to minimize the number of motor vehicles required by the shared vehicle rental system.

To achieve the above object, there is provided in accordance with the present invention a shared vehicle rental system comprising a plurality of motor vehicles, a parking area for a plurality of users to rent motor vehicles therefrom and to return motor vehicles thereto, and a control center for supervising the motor vehicles. The shared vehicle rental system also includes registering means for registering the users in a plurality of groups depending on a usage time zone in which the users use the motor vehicles, memory means for storing registration information of the users, identifying means for identifying the registration information of the users, and control means for supervising the motor vehicles and the parking area based on the registration information of the users.

Preferably, the registration information includes at least information of a first one of the groups to which there belong users who return motor vehicles to the parking area in a first usage time zone and rent motor vehicles from the parking area in a second usage time zone, and information of a second one of the groups to which there belong users who rent motor vehicles from the parking area and thereafter return the motor vehicles to the parking area in a usage time zone substantially between the first usage time zone and the second usage time zone. Specifically, the first one or the second one of the groups is a group of users who use motor vehicles to go to work or school.

According to the present invention, there is also provided a shared vehicle rental system comprising a plurality of motor vehicles having respective communication units, a parking area for a plurality of users to rent motor vehicles therefrom and to return motor vehicles thereto, and a control center for supervising the motor vehicles through the communication units. The control center has means for dividing the users into groups depending on a usage time zone in which the users use the motor vehicles or a direction in which the users move with respect to the parking area, registering the users in the groups, and supervising the motor vehicles and the parking area based on registration information of the users and usage information of the users which is received through the communication units.

Preferably, in the latter shared vehicle rental system, the registration information includes at least information of a first one of the groups to which there belong users who return motor vehicles to the parking area in a first usage time zone and move motor vehicles from the parking area to destinations in a second usage time zone, and information of a second one of the groups to which there belong users who move motor vehicles from the parking area to destinations and thereafter move the motor vehicles in directions to return to the parking area in a usage time zone substantially between the first usage time zone and the second usage time zone. Specifically, the first one of the groups is a group of users who move motor vehicles from houses thereof to the parking area in the first usage time zone to go to work or school and move from the parking area to the houses in said second usage time zone, and the second one of the groups is a group of users who move motor vehicles from the parking area as a starting point and to the parking area as an ending point to do business activities in the usage time zone substantially between the first usage time zone and the second usage time zone.

The control center may comprise means for recording past usage information of the users, and means for selecting, for a user, one of the motor vehicles stored in the parking area based on the recorded past usage information of the user. The control center may also comprise means for controlling the motor vehicles to travel within a predetermined geographical region which contains the parking area.

In each of the shared vehicle rental systems, users are divided into groups depending on the usage time zone or the direction in which they move with respect to the main parking port, i.e., whether they rent or return motor vehicles, and are registered in the groups. Accordingly, the different patterns in which the users of the different groups use motor vehicles can clearly be recognized. The usage or operating efficiency of motor vehicles can easily be increased by allowing users of the second group to use motor vehicles in a usage time zone in which users of the first group do not use motor vehicles. As a consequence, the number of required motor vehicles may be smaller than the total number of registered users, and also a parking space necessary to park the motor vehicles may also be reduced.

If the shared vehicle rental system selects a motor vehicle capable of running over a relatively short distance for a user whose past average traveled distance is relatively short, then the user finds the selected motor vehicle satisfactory for his purpose, and the selected motor vehicle has its operating efficiency increased. The shared vehicle rental system also selects a motor vehicle capable of running over a relatively long distance for a user whose past average traveled distance is relatively long. In this manner, the users can rent motor vehicles which suit their purposes without any waiting time.

The control center may recognize the positions of the motor vehicles at all times based on information from GPSs (Global Positioning Systems) carried on the motor vehicles. If a motor vehicle is about to leave the predetermined geographical region, then the control center transmits an alarm signal to the motor vehicle. The control center can thus manage and control the motor vehicles with a communication installation which may be of relatively low output ratings and of a relatively small scale. Therefore, the shared vehicle rental system can provide the users with a type of service which matches the characteristics of the geographical region.

The above and other objects, features, and advantages of the present invention will become apparent from the following description when taken in conjunction with the accompanying drawings which illustrate a preferred embodiment of the present invention by way of example.

DETAILED DESCRIPTION OF THE PREFERRED EMBODIMENT

Figure 1:
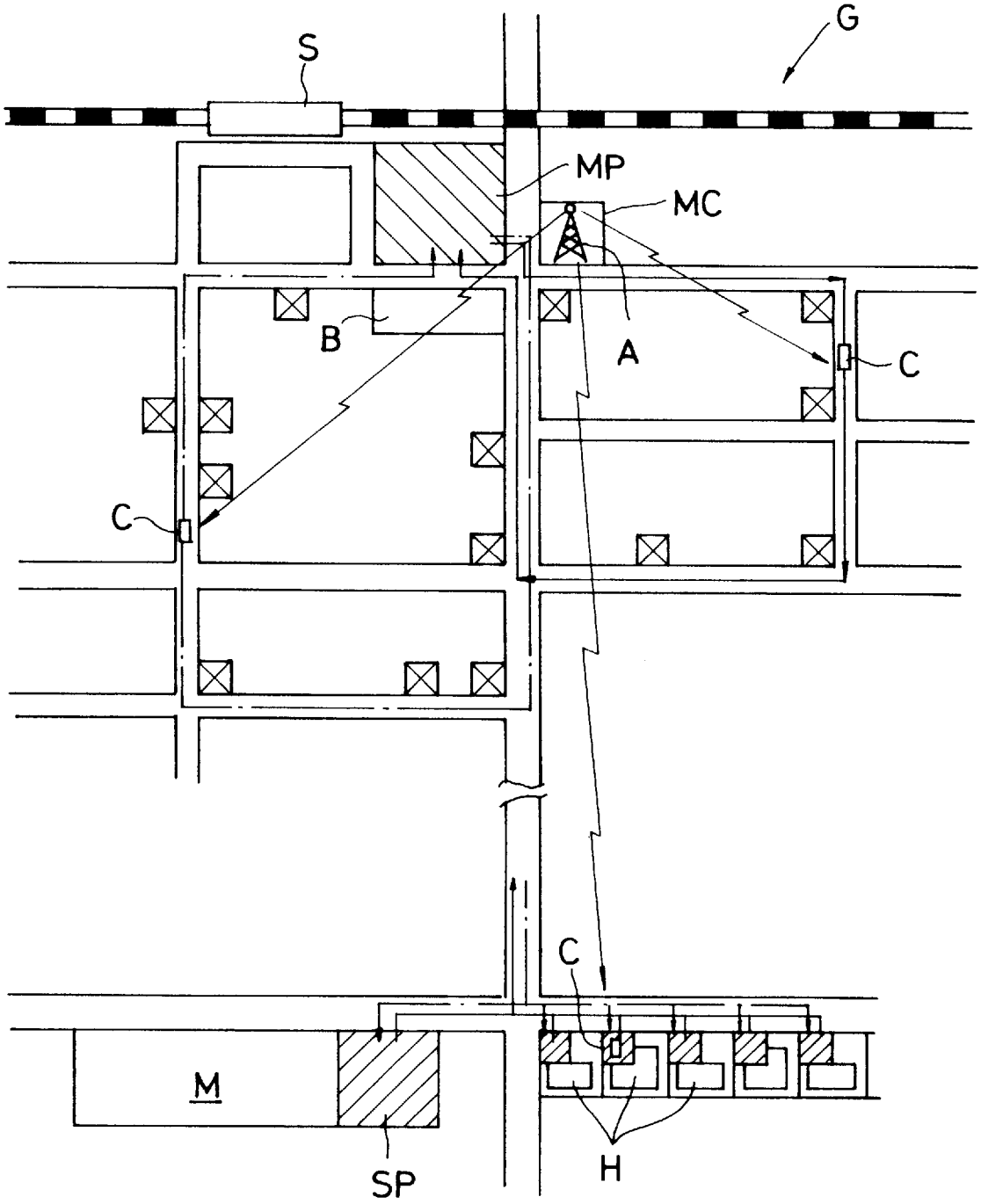
FIG. 1 is a plan view showing a map of a geographical region which is combined with a shared vehicle rental system according to the present invention.

FIG. 1 shows a geographical region which is combined with a shared vehicle rental system according to the present invention. The geographical region, generally denoted at G, is associated with a railroad station S as a community core, and contains business facilities near the railroad station S, the business facilities including a bank B which is a user of the shared vehicle rental system, and individual houses H and an apartment house M remote from the railroad station S, which are inhabited by users of the shared vehicle rental system. The shared vehicle rental system is composed of a plurality of motor vehicles C, a control center MC for supervising the motor vehicles C under centralized control, and a main parking port MP located closely to the railroad station S.

Each of the motor vehicles C comprises a two-passenger vehicle. While the motor vehicles C are illustrated as electric vehicles in this embodiment, they may be motor vehicles propelled by internal combustion engines.

Figure 2:
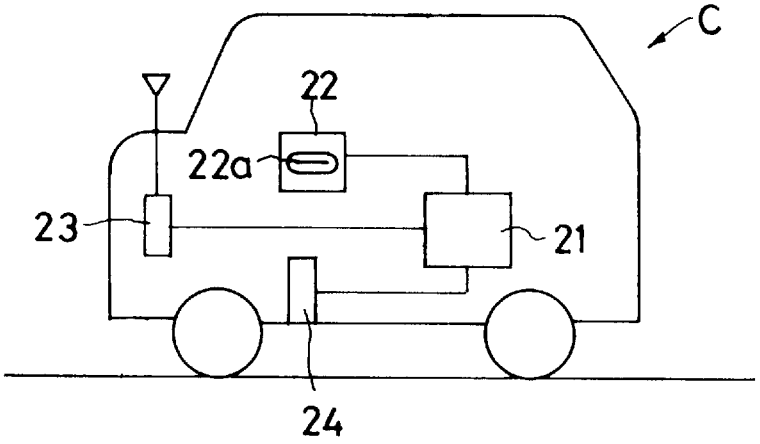
FIG. 2 is a schematic side elevational view of a motor vehicle employed by the shared vehicle rental system.

As shown in FIG. 2, each of the motor vehicles C has an on-board computer 21, a card reader 22, a communication unit 23, and a drive recorder 24. The card reader 22 has a card slot 22*a* opening at an outer panel surface of the motor vehicle C. The card reader 22 transmits information, such as registered information of a user as described later on, recorded on an IC card (not shown) that is inserted into the card slot 22*a*, and records information, such as parking fare information as described later on, received from the on-board computer 21 on the IC card in the card slot 22*a*. The on-board computer 21 has a communication program to be executed for controlling the communication unit 23, and other programs.

The communication unit 23 transmits and receives signals representing various pieces of information to and from communication units in the control center MC and the main parking port MP. The drive recorder 24 records the distance and the time over which the motor vehicle C has traveled, for each rental session.

Figure 3:
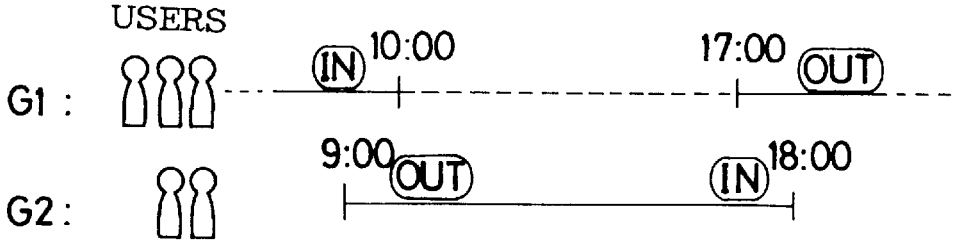
FIG. 3 is a diagram showing the manner in which users are registered in the shared vehicle rental system.

The control center MC has a communication installation A for transmitting signals to and receiving signals from the communication units 23 of the respective motor vehicles C. The control center MC does various activities including recruiting users of the shared vehicle rental system and registering entrants as registered users in groups as shown in FIG. 3. FIG. 3 shows first and second groups G1, G2 of registered users. The first group G1 is composed of users living in the individual houses H and the apartment house M and moving between their houses and the main parking port MP to go to and come back from work or school via the railroad station S. The registered users belonging to the first group G1 move from their houses to the main parking port MP in a first usage time zone until 10 o'clock at latest in the morning as indicated by "IN" (ending point) in FIG. 3, and move from the main parking port MP to their houses in a second usage time zone after 5 o'clock (17 o'clock) in the afternoon as indicated by "OUT" (starting point) in FIG. 3. In this embodiment, the first group G1 contains 300 registered users.

The second group G2 is composed of users as business entities near the railroad station S and in the geographical region G, who use motor vehicles C for business activities such as visiting customers. The registered users belonging to the second group G2 move from the main parking port MP as indicated by "OUT" (starting point) in FIG. 3 and move to the main parking port MP as indicated by "IN" (ending point) in FIG. 3. The registered users of the second group G2 use motor vehicles G in a usage time zone from 9 o'clock in the morning to 6 o'clock (18 o'clock) in the afternoon, approximately between the first and second usage time zones of the first group G1. In this embodiment, the second group G2 contains 200 registered users.

It is assumed that the registered users belonging to the first and second groups G1, G2 are regular users who use motor vehicles C on almost all business days.

The control center MC issues IC cards which store registration information to the registered users. The IC cards also store records of past rental information including times at which the user rented a motor vehicle C, distances and times traveled, and fares, the rental information being recorded each time the user rents a motor vehicle C.

The control center MC also monitors the positions of the motor vehicles C with GPSs or the like carried on the motor vehicles C. If a motor vehicle C is about to leave the geographical region G, the control center MC transmits an alarm signal to the motor vehicle C. The control center MC can thus manage and control the motor vehicles C with the communication installation A which may be of relatively low output ratings and of a relatively small scale.

Figure 4:
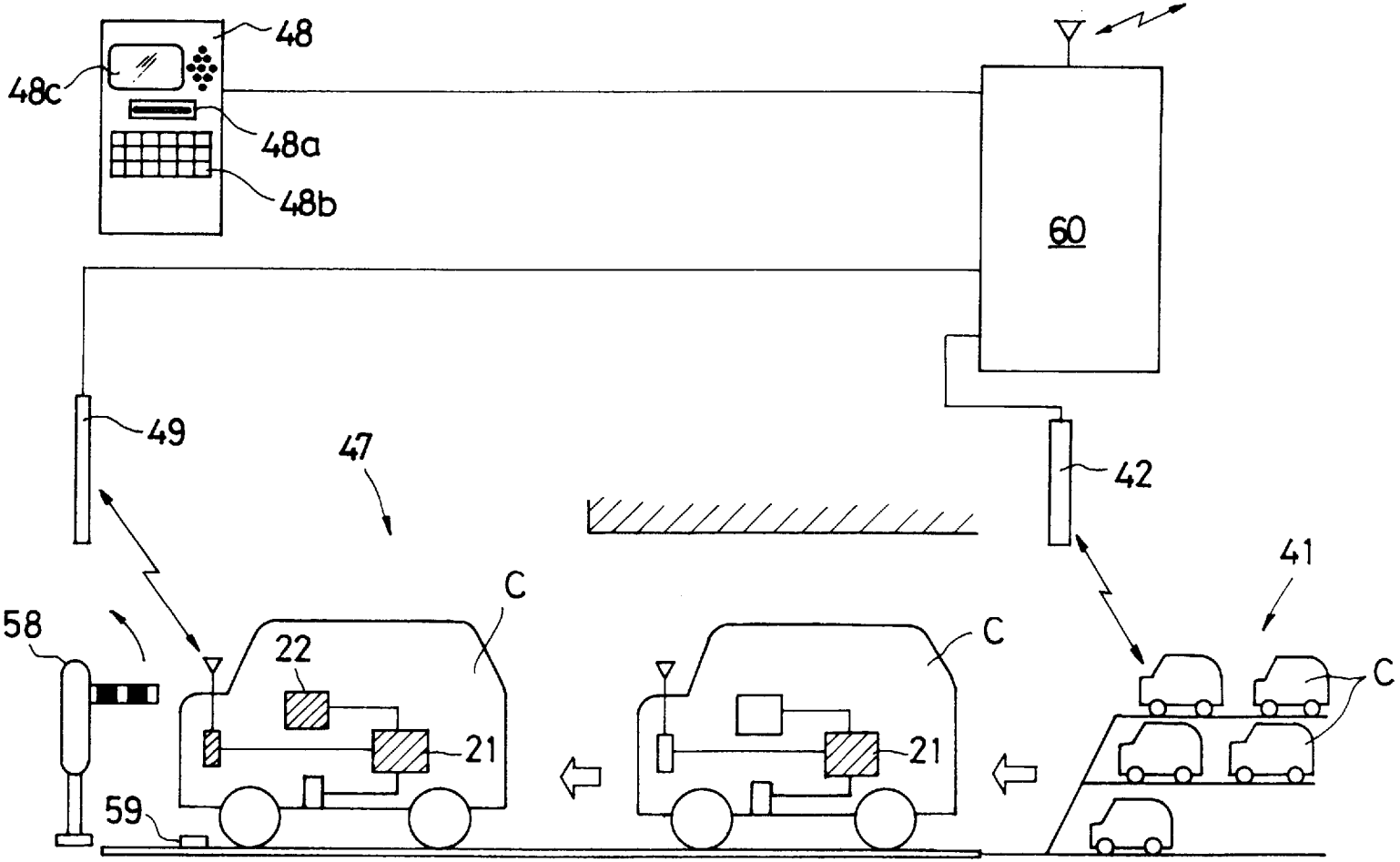
FIG. 4 is a view of a portion of a main parking port in the shared vehicle rental system.
Figure 5:
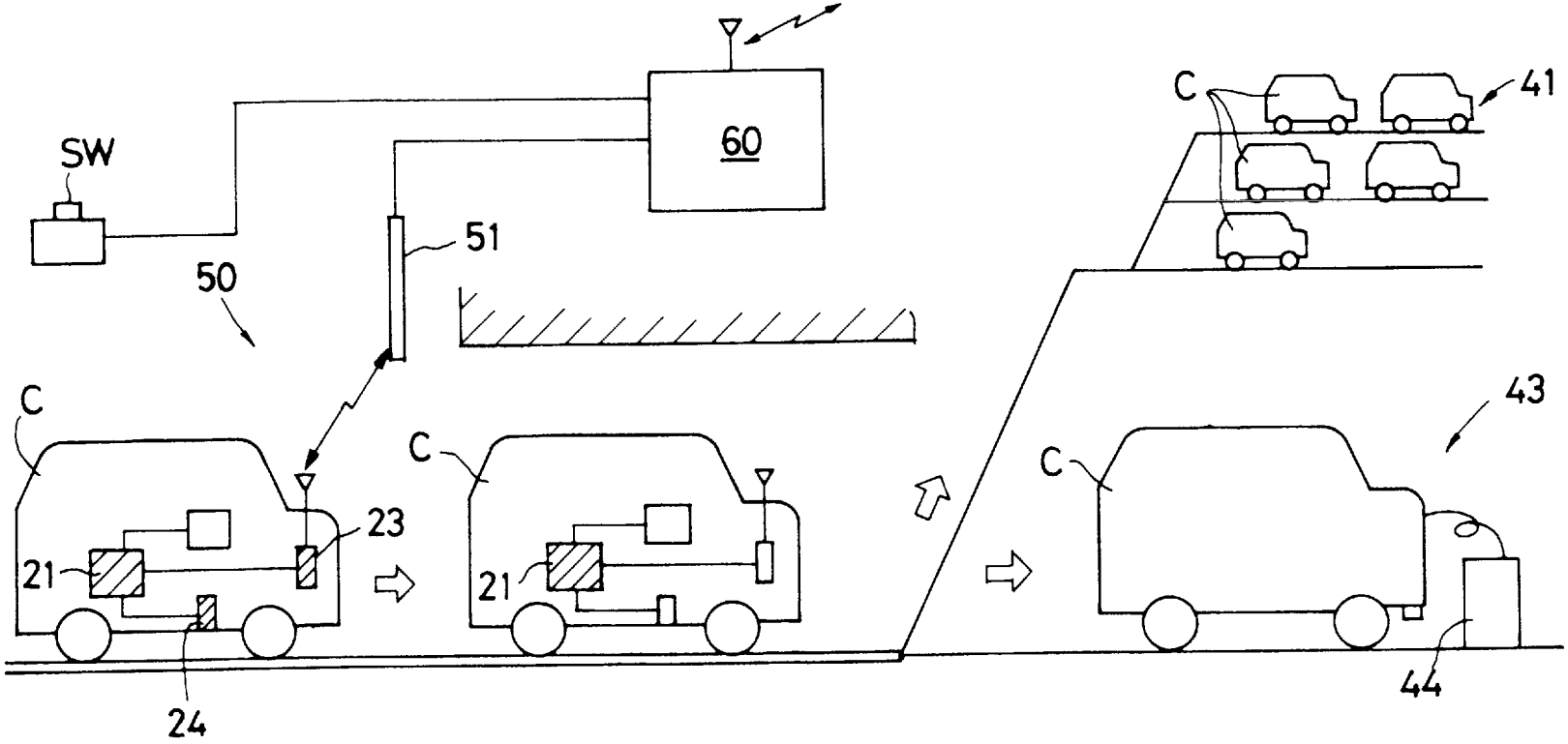
FIG. 5 is a view of another portion of the main parking port in the shared vehicle rental system.

As shown in FIGS. 4 and 5, the main parking port MP has a storage area 41, a charging area 43, a renting area 47, and a returning area 50. The storage area 41 stores a number of motor vehicles C parked closely in arrays. As shown in FIG. 4, a first communication pole 42 is positioned in the storage area 41 at a side near the renting area 47. The charging area 43 shown in FIG. 5 has a charger 44 for charging the batteries on the motor vehicles C. The renting area 47 shown in FIG. 4 has a user interface 48 and a second communication pole 49, and carries out a renting procedure for renting the motor vehicles C. The returning area 50 shown in FIG. 5 has a third communication pole 51, and carries out a returning procedure for returning the motor vehicles C.

The main parking port MP is controlled by a computer 60 positioned therein and connected to the user interface 48 and the first, second, and third communication poles 42, 49, 51.

Management of the motor vehicles C in the main parking port MP will be described below with reference to FIGS. 6 and 7.

Figure 6:
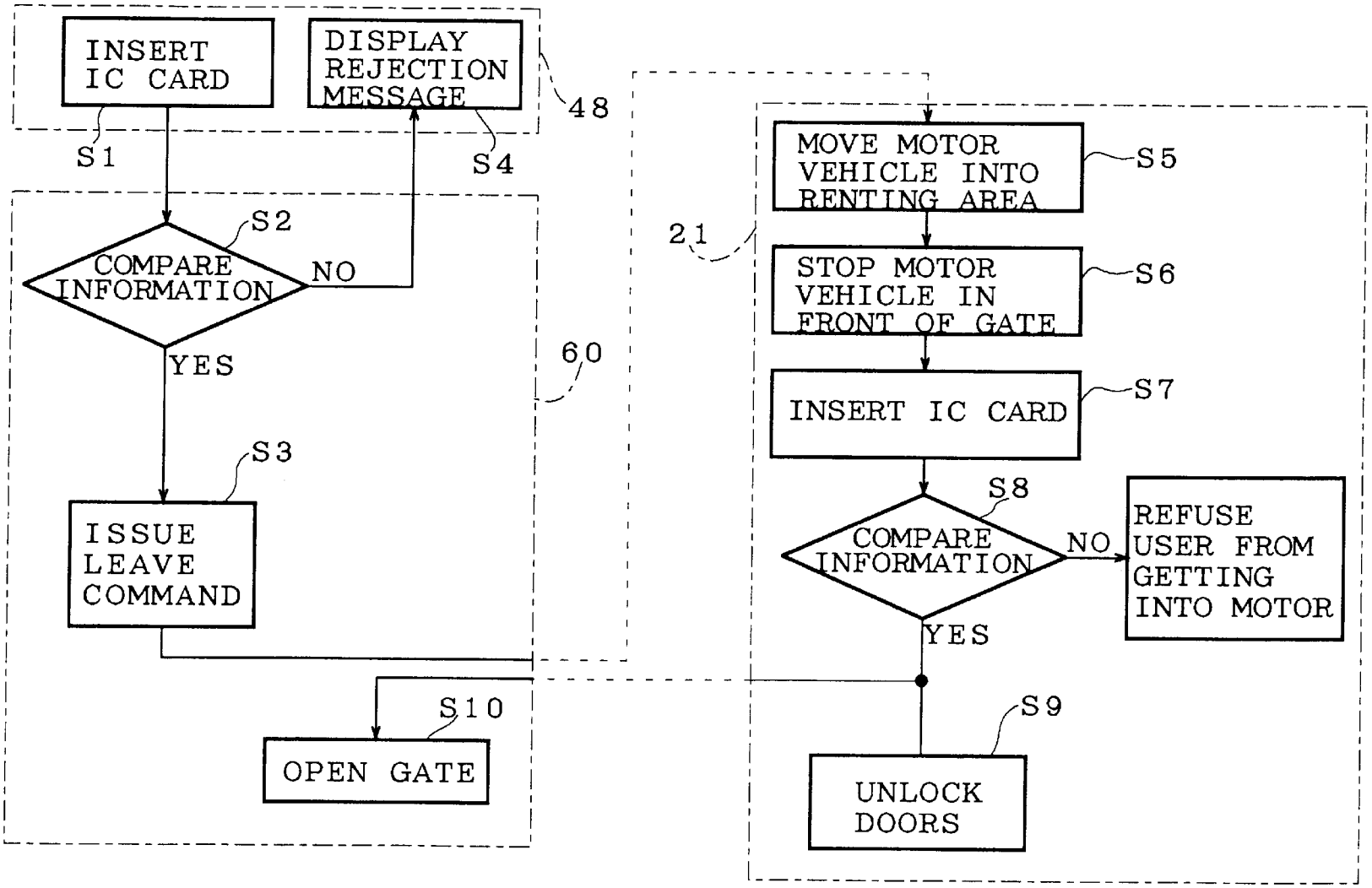
FIG. 6 is a flowchart of a management algorithm for renting a motor vehicle from the main parking port.

FIG. 6 shows a management algorithm for renting a motor vehicle C from the main parking port MP. A registered user who wants to rent a motor vehicle C inserts his own IC card into a card slot 48*a* (see FIG. 4) in the user interface 48, and enters his password through a keyboard 48*b* of the user interface 48 in a step S1 (see FIG. 6).

The user interface 48 reads registration information recorded on the inserted IC card, and sends the registration information and the password to the computer 60. The computer 60 calls registration information recorded in the control center MC, using the password, and compares the registration information from the control center MC with the registration information recorded on the inserted IC card in a step S2. If the compared pieces of registration information agree with each other, then the computer 60 selects one of the available motor vehicles C parked in the storage area 41, and transmits the registration information and a leave command from the first communication pole 42 to the selected motor vehicle C in a step S3. If the compared pieces of registration information do not agree with each other, then the computer 60 displays a message indicating that the user cannot use a motor vehicle on a display screen 48*c* of the user interface 48 in a step S4.

Some of the available motor vehicles C have batteries that are not fully charged, and the other available motor vehicles C have batteries that are fully charged. If the average traveled distance in the past usage recorded on the IC card of the user is relatively short, then the computer 60 selects, for the user, a motor vehicle C whose battery is not fully charged. In the case where the motor vehicles C are motor vehicles propelled by internal combustion engines, the computer 60 selects one of the motor vehicles C based on the remaining amount of fuel, and selects, for the user, a motor vehicle C whose remaining amount of fuel is low. Since the average traveled distance in the past usage of the user is relatively short, the user finds the selected motor vehicle C satisfactory for his purpose, and the selected motor vehicle C has its usage or operating efficiency increased because it is available before its battery is fully charged. If the average traveled distance in the past usage recorded on the IC card of the user is relatively long, then the computer 60 selects, for the user, a motor vehicle C whose battery is fully charged. Consequently, the user can immediately use a motor vehicle C without any waiting time.

In response to the leave command from the computer 60, the on-board computer 21 of the selected motor vehicle C controls the motor vehicle C to move from the storage area 41 to the renting area 47 as shown in FIG. 4 in a step S5. At this time, the motor vehicle C may be self-propelled, carried on a pallet, or moved by any of various existing means. In the renting area 47, the motor vehicle C stops at a mark 59 that is positioned in front of a gate 58 in a step S6.

Then, the user inserts the IC card into the card reader 22 in the motor vehicle C that has stopped in front of the gate 58 in a step S7. The on-board computer 21 determines whether the user is a registered user by comparing the previously received registration information with the registration information read from the IC card by the card reader 22 in a step S8. If the on-board computer 21 confirms that the user is a registered user, then the on-board computer 21 unlocks the doors of the motor vehicle C in a step S9. The user can now get into the motor vehicle C to use the motor vehicle C. The information indicating that the user is a registered user is sent from the on-board computer 21 through the second communication pole 49 to the computer 60 in the main parking port MP, and the computer 60 opens the gate 58 in a step S10. If the on-board computer 21 determines that the user is not a registered user, then the on-board computer 21 does not unlock the doors of the motor vehicle C thereby to keep the user from getting into the motor vehicle C. The information indicating that the user is not a registered user is sent from the on-board computer 21 through the second communication pole 49 to the computer 60. The computer 60 and the control center MC jointly make efforts to carry out a predetermined security procedure.

Figure 7:
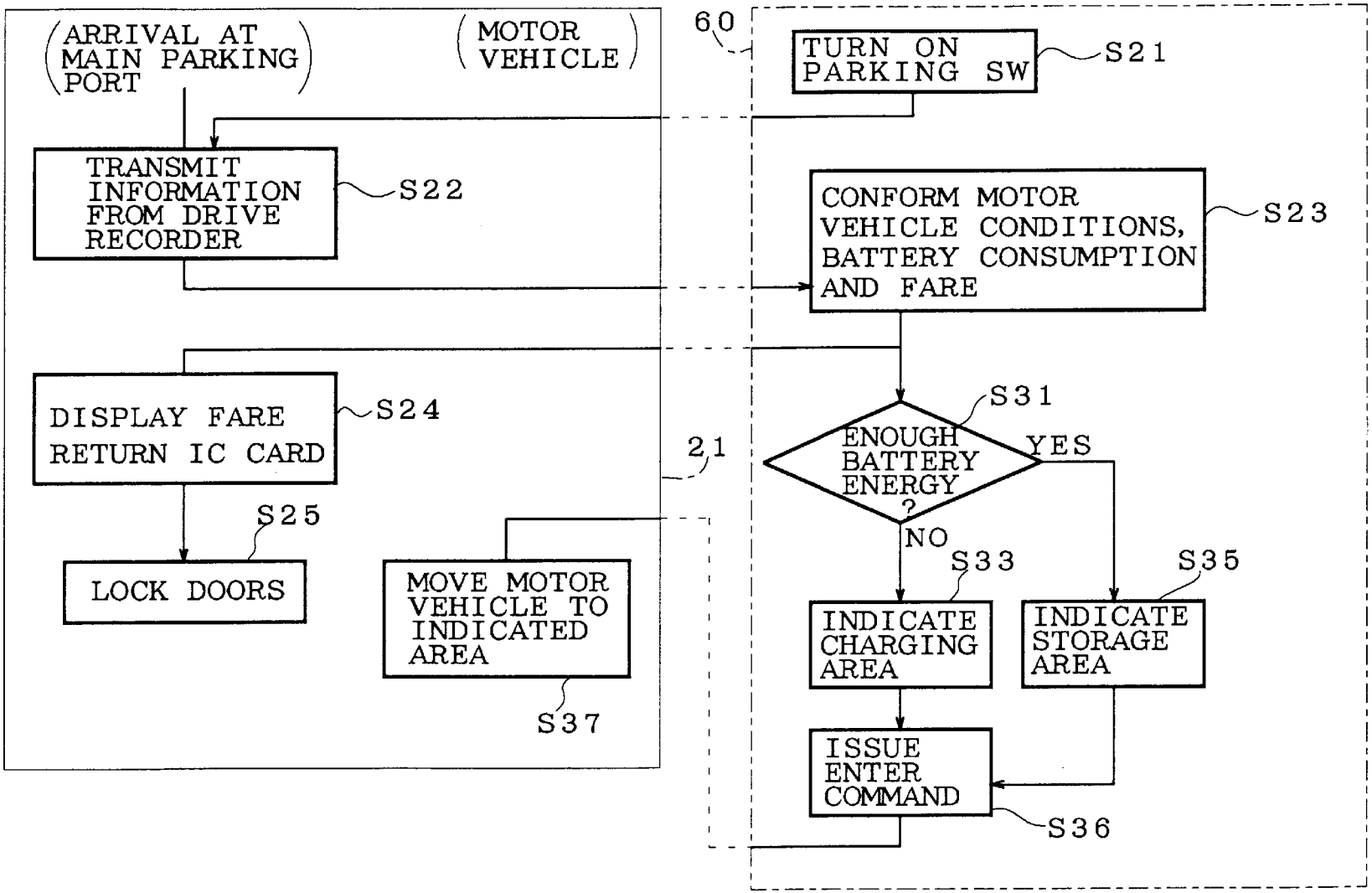
FIG. 7 is a flowchart of a management algorithm for returning a motor vehicle to the main parking port.

FIG. 7 shows a management algorithm for returning a motor vehicle C to the main parking port MP. When an incoming motor vehicle C arrives at the returning area 50 and if a parking switch SW in the returning area 50 is turned on in a step S21, then information relative to the latest usage (travel details) of the motor vehicle C, which is recorded in the drive recorder 24, is sent from the drive recorder 24 through the third communication pole 51 to the computer 60 in a step S22. Based on the supplied information relative of the latest usage, the computer 60 confirms the conditions of the motor vehicle C, the amount of electric energy consumed from the battery on the motor vehicle C, and the rental fare, and then sends fare confirmation information to the motor vehicle C in a step S23.

Upon reception of the fare confirmation information, the on-board computer 21 displays a charged amount for the user to see in a step S24. The charged amount will be withdrawn from the user's bank account at a later time. When the user gets off the motor vehicle C, the IC is returned from the card reader 22 to the user also in the step S24. When the on-board computer 21 confirms that the user has closed the doors of the motor vehicle C, the on-board computer 21 locks the doors of the motor vehicle C in a step S25.

Having confirmed the conditions of the motor vehicle C, the amount of electric energy consumed from the battery on the motor vehicle C, and the rental fare in the step S23, the computer 60 determines whether the battery of the motor vehicle C still remains charged beyond a predetermined amount of electric energy in a step S31. If the stored amount of electric energy in the battery is not enough, then the computer 60 indicates the charging area 43 in a step S33. If the stored amount of electric energy in the battery is enough, then the computer 60 indicates the storage area 41 in a step S35. The computer 60 sends the area indicating information as well as an enter command to the motor vehicle C in a step S36.

In response to the enter command, the motor vehicle C moves to the charging area 43 or the storage area 41 which is indicated by the area indicating information in a step S37, after which all the returning procedure is completed.

Figure 8:
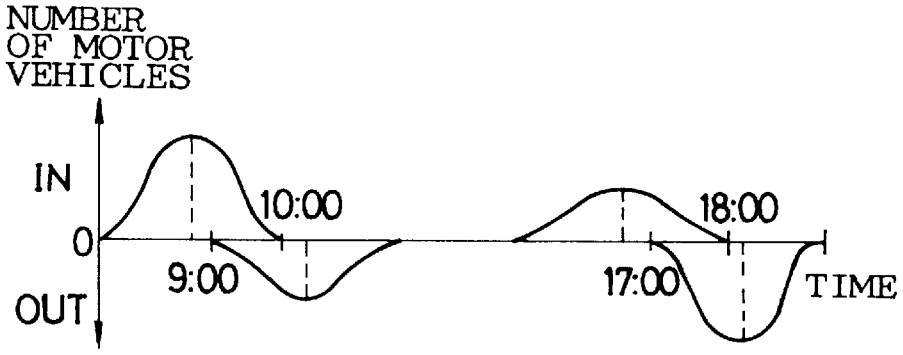
FIG. 8 is a graph showing distributions of motor vehicles as they go into and out of the main parking port over a certain period of time.

An actual operation of the shared vehicle rental system will be described below. Users belonging to the first group G1 use motor vehicles C to move from their houses H, M to the main parking port MP until 10 o'clock in the morning. The users return the motor vehicles C to the main parking port MP, walk to the railroad station S, and get on trains. FIG. 8 shows distributions, over a certain period of time, of motor vehicles C as they are returned to the main parking port MP as indicated by "IN" and rented from the main parking port MP as indicated by "OUT". As can be seen from FIG. 8, the number of motor vehicles C used by the users belonging to the first group G1 has its peak immediately before 9 o'clock in the morning. After 9 o'clock in the morning, users belonging to the second group G2 start to rent motor vehicles C from the main parking port MP, and use the rented motor vehicles C to do business activities visiting their customers indicated by "x". A study of FIG. 8 shows that the number of motor vehicles C used by the users belonging to the second group G2 has its peak immediately after 10 o'clock in the morning.

The users belonging to the second group G2 return their motor vehicles C to the main parking port MP until 18 o'clock. The number of motor vehicles C returned by the users belonging to the second group G2 has its peak immediately before 17 o'clock. After 17 o'clock, users belonging to the first group G1 start to rent motor vehicles C from the main parking port MP and drive back to their houses H, M. The number of motor vehicles C rented by the users belonging to the first group G1 has its peak immediately after 18 o'clock. Preferably, the users of the first group G1 who have gone back home with the rented motor vehicles C charge the batteries of the motor vehicles C with cheap electric energy available at night while the motor vehicles C are being parked in their own parking spaces or a parking lot SP located adjacent to the apartment house M. Such a battery charging practice outside of the charging area 43 in the main parking port MP is effective in reducing the size of the charging area 43.

As described above, the shared vehicle rental system according to the present invention can increase the usage or operating efficiency of the motor vehicles C by allowing users of the second group G2 to use motor vehicles C while those motor vehicles C are not being used by the users of the first group G1. Although the first and second usage time zones of the first group G1 and the usage time zone of the second group G2 slightly overlap each other, since the peaks of the numbers of motor vehicles C rented and returned by the users of first and second groups G1, G2 occur at times off the overlapping time slots, the shared vehicle rental system operates smoothly with about 300 motor vehicles that are approximately as many as the number of users of the first group G1, i.e., fewer than the total number of users of the first and second groups G1, G2. Therefore, the storage area 41 of the main parking port MP may have a storage capacity just enough to store about 300 motor vehicles.

In the shared vehicle rental system, users are divided into groups depending on the usage time zone or the direction in which they move with respect to the main parking port, i.e., whether they rent or return motor vehicles, and are registered in the groups. Accordingly, the different patterns in which the users of the different groups use motor vehicles can clearly be recognized. The usage or operating efficiency of motor vehicles can easily be increased by allowing users of the second group to use motor vehicles in a usage time zone in which users of the first group do not use motor vehicles. As a consequence, the number of required motor vehicles may be reduced, and also a parking space necessary to park the motor vehicles may also be reduced. The shared vehicle rental system is therefore optimum for use in urban regions where buildings and facilities are crowded and available spaces are limited.

The shared vehicle rental system selects available motor vehicles depending on the past usage by users. For example, if the available motor vehicles are electric vehicles, then the shared vehicle rental system selects a motor vehicle whose battery is not fully charged for a user whose past traveled distance is relatively short. In this manner, the shared vehicle rental system can further increase the operating efficiency of motor vehicles.

Although a certain preferred embodiment of the present invention has been shown and described in detail, it should be understood that various changes and modifications may be made therein without departing from the scope of the appended claims.

What is claimed is:

1. A shared vehicle rental system comprising:

a plurality of motor vehicles;

a parking area for a plurality of users to rent said motor vehicles therefrom and to return said motor vehicles thereto;

a control center for supervising said motor vehicles and for recruiting and selecting prospective users of said shared vehicle rental system based at least on a usage time zone of each user, said control center establishing at least two mutually exclusive, alternate usage time zones;

registering means for registering said users in a plurality of groups based on said usage time zone in which the users use the motor vehicles, wherein at least one group of users is registered for each of said alternate usage time zones;

memory means for storing registration information of said users from said registering means; and control means for supervising the rental of said motor vehicles and said parking area based on the registration information of said users for using the same said motor vehicles by two different said groups of users during said two alternate usage time zones.

2. A shared vehicle rental system comprising:

a plurality of motor vehicles having respective communication units;

a parking area for a plurality of users to rent said motor vehicles therefrom and to return said motor vehicles thereto; and a control center for supervising said motor vehicles through said communication units and for recruiting and selecting prospective users of said shared vehicle rental system based at least on a usage time zone of each user, said control center establishing at least two mutually exclusive, alternate usage time zones; and said control center having means for dividing said users into groups, based on at least one of either a usage time zone in which the users use the motor vehicles or a direction in which the users move with respect to the parking area, for registering the users in said groups wherein at least one group of users is registered for each of said alternate usage time zones, and for supervising usage said motor vehicles and said parking area based on registration information of said users and usage information of the users which is received through said communication units for using the same said motor vehicles by two different said groups of users during said two alternate usage time zones.

3. A shared vehicle rental system comprising:

a plurality of motor vehicles having respective communication units;

a parking area for a plurality of users to rent motor vehicles therefrom and to return motor vehicles thereto; and a control center for supervising said motor vehicles through said communication units and for recruiting and selecting prospective users of said shared vehicle rental system based at least on a usage time zone of each user;

said control center having means for dividing said users into groups depending on at least one of either a usage time zone in which the users use the motor vehicles or a direction in which the users move with respect to the parking area, registering the users in said groups, and supervising said motor vehicles and said parking area based on registration information of said users and usage information of the users which is received through said communication unit; and wherein said control center comprises means for recording past usage information of the users, and means for selecting, for a user, one of the motor vehicles stored in said parking area based on the recorded past usage information of said user.

4. A shared vehicle rental system comprising:

a plurality of motor vehicles;

a parking area for a plurality of users to rent motor vehicles therefrom and to return motor vehicles thereto;

a control center for supervising said motor vehicles and for recruiting and selecting prospective users of said shared vehicle rental system based at least on a usage time zone of each user;

registering means for registering said users in a plurality of groups depending on said usage time zone in which the users use the motor vehicles;

memory means for storing registration information of said users; and control means for supervising said motor vehicles and said parking area based on the registration information of said users; and wherein said control center comprises means for recording past usage information of the users, and means for selecting, for a user, one of the motor vehicles stored in said parking area based on the recorded past usage information of said user.

5. A shared vehicle rental system according to claim 1, wherein said control center comprises means for controlling said motor vehicles to travel within a predetermined geographical region which contains said parking area.

6. A shared vehicle rental system according to claim 2, wherein said control center comprises means for controlling said motor vehicles to travel within a predetermined geographical region which contains said parking area.

7. A shared vehicle rental system according to claim 1, 4 or 5, wherein said registration information includes at least information of a first one of said groups to which there belong users who return motor vehicles to said parking area in a first usage time zone and rent motor vehicles from said parking area in a second usage time zone, and information of a second one of said groups to which there belong users who rent motor vehicles from said parking area and thereafter return the motor vehicles to said parking area in a usage time zone substantially between said first usage time zone and said second usage time zone.

8. A shared vehicle rental system according to claim 7, wherein said first one or said second one of the groups is a group of users who use motor vehicles to go to and from at least one of either work or school at the beginning and end of a day, respectively.

9. A shared vehicle rental system according to claim 4, 3 or 6, wherein said registration information includes at least information of a first one of said groups to which there belong users who return motor vehicles to said parking area in a first usage time zone and move motor vehicles from said parking area to destinations in a second usage time zone, and information of a second one of said groups to which there belong users who move motor vehicles from said parking area to destinations and thereafter move the motor vehicles in directions to return to said parking area in a usage time zone substantially between said first usage time zone and said second usage time zone.

10. A shared vehicle rental system according to claim 9, wherein said first one of the groups is a group of users who move motor vehicles from houses thereof to said parking area in said first usage time zone to go to and from at least one of either work or school and move from said parking area to the houses in said second usage time zone, and said second one of the groups is a group of users who move motor vehicles from said parking area as a starting point and to said parking area as an ending point to do business activities in a usage time zone substantially between said first usage time zone and said second usage time zone.

11. A shared vehicle rental system comprising:

a plurality of motor vehicles having respective communication units;

a parking area for a plurality of users to rent motor vehicles therefrom and to return motor vehicles thereto; and a control center for supervising said motor vehicles through said communication units and for recruiting and selecting prospective users of said shared vehicle rental system based at least on a usage time zone of each user;

said control center having means for dividing said users into groups depending on at least one of either a usage time zone in which the users use the motor vehicles or a direction in which the users move with respect to the parking area, registering the users in said groups, and supervising said motor vehicles and said parking area based on registration information of said users and usage information of the users which is received through said communication unit; and wherein said control center includes means for monitoring the locations of said motor vehicles and transmitting an alarm signal to a vehicle that leaves a predetermined geographical region which contains said parking area.

12. A shared vehicle rental system comprising:

a plurality of motor vehicles;

a parking area for a plurality of users to rent motor vehicles therefrom and to return motor vehicles thereto;

a control center for supervising said motor vehicles and for recruiting and selecting prospective users of said shared vehicle rental system based at least on a usage time zone of each user;

registering means for registering said users in a plurality of groups depending on said usage time zone in which the users use the motor vehicles;

memory means for storing registration information of said users; and control means for supervising said motor vehicles and said parking area based on the registration information of said users; and wherein said control center includes means for monitoring the locations of said motor vehicles and transmitting an alarm signal to a vehicle that leaves a predetermined geographical region which contains said parking area.

* * * * *